US005895779A

United States Patent [19]

Boffa

[11] Patent Number: 5,895,779

[45] Date of Patent: Apr. 20, 1999

[54] LUBRICATING OIL HAVING IMPROVED FUEL ECONOMY RETENTION PROPERTIES

[75] Inventor: Alexander B. Boffa, Glen Gardner, N.J.

[73] Assignee: Exxon Chemical Patents Inc, Linden, N.J.

[21] Appl. No.: 09/052,580

[22] Filed: Mar. 31, 1998

[51] Int. Cl.[6] ..... C10M 139/00

[52] U.S. Cl. ..... 508/555; 508/364; 508/379; 508/445; 508/551

[58] Field of Search ..... 508/445, 364, 508/551, 555, 379

[56] References Cited

U.S. PATENT DOCUMENTS

| | | | |
|---|---|---|---|
| 2,805,997 | 9/1957 | Benoit et al. | 508/480 |
| 4,178,278 | 12/1979 | Reynolds, Jr. . | |
| 4,360,438 | 11/1982 | Rowan et al. . | |
| 4,479,883 | 10/1984 | Shaub et al. . | |
| 4,501,678 | 2/1985 | Katayama et al. . | |
| 4,529,526 | 7/1985 | Inoue et al. . | |
| 4,648,985 | 3/1987 | Thorsell et al. . | |
| 4,846,983 | 7/1989 | Ward, Jr. | 508/363 |
| 4,978,464 | 12/1990 | Coyle et al. | 508/379 |
| 5,281,347 | 1/1994 | Igarashi et al. . | |
| 5,356,547 | 10/1994 | Arai et al. . | |
| 5,627,146 | 5/1997 | Tanaka et al. . | |
| 5,672,572 | 9/1997 | Arai et al. . | |
| 5,696,063 | 12/1997 | Tokashiki et al. . | |

FOREIGN PATENT DOCUMENTS

| | | |
|---|---|---|
| 3086796 | 4/1991 | Japan . |
| 406041568 | 2/1994 | Japan . |

*Primary Examiner*—Jacqueline V. Howard
*Assistant Examiner*—Cephia D. Toomer
*Attorney, Agent, or Firm*—John J. Mahon

[57] ABSTRACT

A lubricating oil composition which exhibits improved fuel economy and fuel economy retention which contains the combination of (a) a dithiocarbamate of the formula $R_1(R_2)N—C(:S)—S—(CH_2)_n—S—(:S)C—N(R_2)R_1$ where n is 1–4 and $R_1$ and $R_2$ are $C_1$–$C_{20}$ alkyl and (b) an oil soluble trinuclear friction modifying molybdenum compound, the two components functioning to provide an improvement in the friction reducing properties of the composition.

7 Claims, No Drawings

LUBRICATING OIL HAVING IMPROVED FUEL ECONOMY RETENTION PROPERTIES

This invention relates to lubricating oils particularly useful for passenger car engines. More particularly, the invention relates to lubricating oil compositions which exhibit improvements in fuel economy and fuel economy retention.

The present invention is based on the discovery that the use of certain trinuclear molybdenum compounds in combination with a dithiocarbamate provides a significant increase in fuel economy as well as fuel economy retention as observed by coefficient of friction studies for lubricating oils containing these two additives.

The use of molybdenum compounds as fuel economy additives or friction reducing agents is well known in the art and is illustrated, for example, in U.S. Pat. 4,501,678 issued Feb. 26, 1994 to Katayama et al. and in U.S. Pat. No. 4,479,883 issued Oct. 30, 1984 to Shaub et al. Katayama discloses the combination of dimeric, but not trimeric, Mo compounds in combination with dithiocarbamates.

In accordance with this invention there has been discovered a lubricating oil composition exhibiting improved fuel economy and fuel economy retention properties which comprises an oil of lubricating viscosity containing (a) 0.05 to 10%, preferably 0.1 to 1.5 wt. % of an oil soluble dithiocarbamate of the formula $R_1(R_2)N—C(:S)—S—(CH_2)_n—S—(:S)C—N(R_2)R_1$ where $R_1$ and $R_2$ are $C_1$–$C_{20}$ alkyl and n is 1–4, and (b) an oil soluble trinuclear molybdenum compound of the formula $Mo_3S_kL_n$ where k is 4–10, n is 1–4 and L is an organic ligand having sufficient carbon atoms to render the trinuclear molybdenum compound oil soluble, the trinuclear molybdenum compound being in such an amount so as to provide 10 to 1000 ppm molybdenum in the composition.

Trinuclear molybdenum compounds used in this invention are represented by the formula $Mo_3S_kL_n$, wherein k=4–10, n is 1–4 and L represents an organic ligand or ligands.

L may be independently selected from the group of:

$—X—R$, $—(X_1)(X_2)CR$, $—(X_1)(X_2)CYR$, $—(X_1)(X_2)CN(R_1)(R_2)$, or $—(X_1)(X_2)P(OR_1)(OR_2)$ and mixtures thereof, and perthio derivatives thereof wherein X, $X_1$, $X_2$ and Y are independently selected from the group of oxygen and sulfur, and wherein $R_1$, $R_2$, and R are independently selected from the group consisting of H and organo groups that may be the same or different. Preferably the organo groups are hydrocarbyl groups such as alkyl (e.g., in which the carbon atom attached to the remainder of the ligand is primary, secondary or tertiary), aryl, substituted aryl and ether groups. More preferably, all ligands are the same.

Importantly, the organo groups of the ligands have a sufficient number of carbon atoms to render the compounds soluble in oil. The compounds' oil solubility may be influenced by the number of carbon atoms in the ligands. In the compounds in the present invention, the total number of carbon atoms present among all of the organo groups of the compounds' ligands typically will be at least 21, e.g. 21 to 800, such as at least 25, at least 30 or at least 35. For example, the number of carbon atoms in each alkyl group will generally range between 1 to 100, preferably 1 to 40 and more preferably between 3 and 20. Preferred ligands include dialkyldithiophosphate ("ddp"), xanthates, thioxanthates, dialkylphosphate, dialkyldithiocarbamate ("dtc"), and carboxylate and of these the dtc is more preferred, particularly when the alkyl is 8 to 18 carbon atoms.

Multidentate organic ligands containing at least two of the above functionalities are also capable of binding to at least one of the trinuclear cores and serving as ligands. Without wishing to be bound by any theory, it is believed that one or more trinuclear molybdenum cores may be bound or interconnected by means of at least one of these multidentate ligands. Such structures fall within the scope of this invention. This includes the case of a multidentate ligand having multiple connections to one core.

Those skilled in the art will realize that formation of the compounds will require selection of appropriate ligands having suitable charge to balance the corresponding core's charge.

The term "hydrocarbyl" denotes a substituent having carbon atoms directly attached to the remainder of the ligand and is predominantly hydrocarbyl in character within the context of this invention. Such substituents include the following: (1) hydrocarbon substituents, that is, aliphatic (for example alkyl or alkenyl), alicyclic (for example cycloalkyl or cycloalkenyl) substituents, aromatic-, aliphatic- and alicyclic-substituted aromatic nuclei and the like, as well as cyclic substituents wherein the ring is completed through another portion of the ligand (that is, any two indicated substituents may together form an alicyclic group); (2) substituted hydrocarbon substituents, that is those containing nonhydrocarbon groups which, in the context of this invention, do not alter the predominantly hydrocarbyl character of the substituent. Those skilled in the art will be aware of suitable groups (e.g., halo, (especially chloro and fluoro), amino, alkoxyl, mercapto, alkylmercapto, nitro, nitroso, sulfoxy, etc.); (3) hetero substituents, that is, substituents which, while predominantly hydrocarbon in character within the context of this invention, contain atoms other than carbon present in a chain or ring otherwise composed of carbon atoms.

Generally, the trinuclear molybdenum containing compounds can be prepared by reacting a suitable molybdenum source, with a ligand source and, optionally, with a sulfur abstracting agent. This may be carried out in a suitable liquid medium which may be aqueous or organic. Oil-soluble or -dispersible trinuclear molybdenum compounds can be prepared, for example, by reacting in the appropriate solvent (s) $(M^1)_2Mo_3S_{13}.n(H_2O)$, wherein n varies between 0 and 2 and includes non-stoichiometric values, with a suitable ligand source such as a tetraalkylthiuram disulfide. Other oil-soluble or -dispersible trinuclear molybdenum compounds can be formed by reacting $(M^1)_2Mo_3S_{13}.n(H_2O)$, wherein n varies between 0 and 2 and includes nonstoichiometric values, a ligand source such as tetraalkylthiuram disulfide, dialkyldithiocarbamate, or dialkyldithiophosphate, and a sulfur abstracting agent such as cyanide ions, sulfite ions, or substituted phosphines. Alternatively, a trinuclear molybdenum-sulfur halide salt such as $[M^1]_2[Mo_3S_7A_6]$, wherein A=Cl, Br, or I, may be reacted with a ligand source such as a dialkyldithiocarbamate or dialkyldithiophosphate in the appropriate solvent(s) to form an oil-soluble or dispersible trinuclear molybdenum compound. In the above formula, $M^1$ is a counter ion such as $NH_4$. The trinuclear molybdenum compounds are related by the number of sulfur atoms in the molybdenum core. Within the disclosed range, the number of the sulfur atoms in the core may be altered by the addition of sulfur abstractors such as cyanide and substituted phosphines, or sulfur donators such as elemental sulfur and organic trisulfides to the trinuclear molybdenum compounds.

Preferred trinuclear molybdenum compounds for use in the compositions of this invention are those of the formula $Mo_3S_7((alkyl)_2dtc)_4$ where the alkyl has about 8 to 18 carbon atoms and the alkyl being preferably a "coco" alkyl chain which is a mixture of chains of varying even numbers of carbon atoms from typically a C8 to C18 alkyl, mainly C10, C12 and C14 alkyls derived from coconut oil.

The preferred amount of trinuclear molybdenum is that which will provide about 50 to 750 ppm Mo in the finished oil, most preferably about 150 to 500 ppm.

The dithiocarbamate (dtc) which is used in this invention is represented by the formula $R_1(R_2)N—C(:S)—S(CH_2)_n—S—C(:S)N(R_2)R_1$ where n is 1–4 and $R_1$ and $R_2$ may be $C_1$–$C_{20}$ alkyl groups. Preferably n is 1 and R1 and R2 are butyl, the compound being 4,4'-methylene-bis (dibutyldithiocarbamate) sold as "Vanlube 7723" by Vanderbilt Chemical Co. It has been found that use of the dtc of the formula above in combination with the trinuclear Mo compound provides to the oil enhanced fuel economy retention characteristics not obtained with chemically similar thiocarbamate compounds known to be lubricating oil additives, such as zinc diamyl dithiocarbamate ("Vanlube AZ") and 1,2-dicarboxyethyl dithiocarbamate having C4 alkyl groups ("Vanlube 732").

The preferred amount of the dtc of this invention present in the oil is 0.1% to 1.5% by weight of the lubricating oil composition.

Natural oils useful as basestocks in this invention include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Alkylene oxide polymers and interpolymers and derivatives thereof where the terminal hydroxyl groups have been modified by esterification, etherification, etc., are a class of known synthetic lubricating oils useful as basestocks in this invention. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils useful in this invention comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tertbutylphenyl) silicate, hexa-(4-methyl-2-pentoxy) disiloxane, poly(methyl) siloxanes and poly (methylphenyl) siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improved one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The compositions of this invention are principally used in the formulation of crankcase lubricating oils for passenger car engines. The additives listed below are typically used in such amounts so as to provide their normal attendant functions. Typical amounts for individual components are also set forth below. All the values listed are stated as mass percent active ingredient in the total lubricating oil composition.

| ADDITIVE | MASS % (Broad) | MASS % (Preferred) |
|---|---|---|
| Ashless Dispersant | 0.1–20 | 1–8 |
| Metal Detergents | 0.1–15 | 0.2–9 |
| Corrosion Inhibitors | 0–5 | 0–1.5 |
| Metal Dihydrocarbyl Dithiophosphate | 0.1–6 | 0.1–4 |
| Supplemental Anti-oxidant | 0–5 | 0.01–3 |
| Pour Point Depressant | 0.01–5 | 0.01–1.5 |
| Anti-foaming Agent | 0–5 | 0.001–0.15 |
| Supplemental Anti-wear Agents | 0–5 | 0–2 |
| Friction Modifier | 0–5 | 0–1.5 |
| Viscosity Modifier | 0.01–6 | 0–4 |

The individual additives may be incorporated into a basestock in any convenient way. Thus, each of the components can be added directly to the basestock by dispersing or dissolving it in the basestock at the desired level of concentration. Such blending may occur at ambient temperature or at an elevated temperature.

Preferably, all the additives except for the viscosity modifier and the pour point depressant are blended into a concentrate or additive package described herein as the additive package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

The concentrate is conveniently made in accordance with the method described in U.S. Pat. No. 4,938,880. That patent describes making a pre-mix of ashless dispersant and metal detergents that is pre-blended at a temperature of at least about 200° C. Thereafter, the pre-mix is cooled to at least 85° C. and the additional components are added.

The final crankcase lubricating oil formulation may employ from 2 to 20 mass % and preferably 4 to 15 mass % of the concentrate of additive package with the remainder being base stock.

Ashless dispersants maintain in suspension oil insolubles resulting from oxidation of the oil during wear or combustion. They are particularly advantageous for preventing the precipitation of sludge and the formation of varnish, particularly in gasoline engines.

Ashless dispersants comprise an oil soluble polymeric hydrocarbon backbone bearing one or more functional groups that are capable of associating with particles to be dispersed. Typically, the polymer backbone is functionalized by amine, alcohol, amide, or ester polar moieties, often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone of these dispersants is typically derived from an olefin polymer or polyene, especially polymers comprising a major molar amount (i.e., greater than 50 mole %) of a $C_2$ to $C_{18}$ olefin (e.g., ethylene, propylene, butylene, isobutylene, pentene, octene-1, styrene), and typically a $C_2$ to $C_5$ olefin. The oil soluble polymeric hydrocarbon backbone may be a homopolymer (e.g., polypropylene or polyisobutylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, for example, 1 to 10 mole %, is an $\alpha,\omega$-diene, such as a $C_3$ to $C_{22}$ non-conjugated diolefin (for example, a copolymer of isobutylene and butadiene, or a copolymer of ethylene, propylene and 1,4-hexadiene or 5-ethylidene-2-norbornene).

The viscosity modifier (VM) functions to impart high and low temperature operability to a lubricating oil. The VM used may have that sole function, or may be multifunctional.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic ester, and partially hydrogenated copolymers of styrene/isoprene, styrene/butadiene, and isoprene/butadiene, as well as the partially hydrogenated homopolymers of butadiene and isoprene and isoprene/divinylbenzene.

Metal-containing or ash-forming detergents may be present and these function both as detergents to reduce or remove deposits and as acid neutralizers or rust inhibitors, thereby reducing wear and corrosion and extending engine life. Detergents generally comprise a polar head with long hydrophobic tail, with the polar head comprising a metal salt of an acid organic compound. The salts may contain a substantially stoichiometric amount of the metal in which they are usually described as normal or neutral salts, and would typically have a total base number (TBN), as may be measured by ASTM D-2896 of from 0 to 80. It is possible to include large amounts of a metal base by reacting an excess of a metal compound such as an oxide or hydroxide with an acid gas such as carbon dioxide. The resulting overbased detergent comprises neutralized detergent as the outer layer of a metal base (e.g., carbonate) micelle. Such overbased detergents may have a TBN of 150 or greater, and typically from 250 to 450 or more.

Detergents that may be used include oil-soluble neutral and overbased sulfonates, phenates, sulfurized phenates, thiophosphonates, salicylates, and nephthenates and other oil-soluble carboxylates of a metal, particularly the alkali, e.g., sodium, potassium, lithium and magnesium. Preferred are neutral or overbased calcium and magnesium phenates and sulfonates.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with P2S5 and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

Oxidation inhibitors or antioxidants reduce the tendency of basestocks to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oils soluble phenates and sulfurized phenates, phosphosulfurized or sulfurized hydrocarbons, phosphorous esters, metal thiocarbamates, oil soluble copper compound as described in U.S. Pat. No. 4,867,890, and molybdenum containing compounds.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but are typically not required with the formulation of the present invention. Typically such compounds are the thiadiazole polysulfides containing from 5 to 50 carbon atoms, their derivatives and polymers thereof. Derivatives of 1,3,4-thiadiazoles such as those described in U.S. Pat. Nos. 2,719,125; 2,719,126; and 3,087,932; are typical. Other similar material are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in U.K. Patent Specification No. 1,560,830. Benzotriazoles derivatives also fall within this class of additives. When these compounds are included in the lubricating composition, they are preferably present in an amount not exceeding 0.2 wt. % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil improvers, lower the minimum temperature at which the fluid will flow or can be poured. Such additives are well known. Typical of those additives which improve the low temperature fluidity of the fluid are $C_8$ and $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The invention is further illustrated by the following examples which are not to be considered as limitative of its scope.

Friction measurements were made using a high frequency reciprocating rig (HFRR) after an accelerated aging of the test oils in which air and $NO_2$ are added to a 30 ml sample of test oil containing soluble iron, the sample being in a test tube in a silicone oil bath. Aging conditions were 2.2 ml/min. $NO_2$ and 26 ml/min. air, 155° C. oil bath temperature and 40 ppm soluble Fe (ferric acetylacetonate) in chloroform. These aging laboratory conditions have been demonstrated to give a correlation relative to the Sequence IIIE engine test. The HFRR parameters were 100° C. oil temperature, 400 g. load, 20 Hz stroke frequency and 1 mm stroke length. The disks were 650 Hv, AISI 52100 steel, polished to 0.05 micron Ra roughness.

EXAMPLE 1

An oil was prepared composed of the following (percentages are by weight active ingredient):

1.925%—dispersant formed by reacting a neo acid functionalized ethylene (45%) 1-butene copolymer of Mn 3500 with a polyalkylene polyamine having 7 N atoms per mole, as disclosed in U.S. Pat. No. 5,696,064

0.001%—silicone antifoam (45% vol. solution in mineral oil)

0.672%—calcium $C_{24}$ alkyl benzene sulfonate (TBN 400)

0.3%—$C_8$ hindered alkylphenol antioxidant 0.7%—nonyldiphenylamine antioxidant 0.56%—zinc dialkyldithiophosphate antiwear additive 0.407%—Mo3S7 $((coco)_2dtc)_4$—anti-friction additive (trimeric Mo) (provides 500 ppm Mo in the oil)

0.20%—copper salt of polyisobutenyl succinic anhydride—antioxidant 0.34%—borated polyisobutenyl (Mn 950) succinimide dispersant 0.40%—olefin copolymer viscosity modifier 1.00%—4,4'-methylene-bis(dibutyldithiocarbamate), "Vanlube 7723"

Balance—mineral oil basestock

EXAMPLE 2

(Comparison)

Another oil was prepared having the same ingredients as the oil of Example 1 except the Vanlube 7723 was replaced with "Vanlube AZ", which is zinc diamyldithiocarbamate.

EXAMPLE 3

(Comparison)

Another oil was prepared having the same ingredients as the oil of Example 1 except that the Vanlube 7723 was replaced by "Vanlube 732", which is 1,2-dicarboethoxyethyl dithiocarbamate having $C_4$ alkyl groups.

A comparison of friction data for these three oils is reported below.

| Coefficient of Friction | | | |
|---|---|---|---|
| Ex. 1 | Ex. 2 | Ex. 3 | Hours of Aging at 155° C. |
| .115 | .130 | .103 | 0 |
| .088 | .083 | .080 | 22 |
| .080 | .095 | .082 | 30 |
| .085 | .136 | .135 | 46 |

The data show the superior friction retention of the oil of Example 1 due to the combination of trimeric molybdenum compound and the dithiocarbamate of this invention. The results at 30 hours are significant.

I claim:

1. A lubricating oil composition exhibiting improved fuel economy and fuel economy retention properties which comprises an oil of lubricating viscosity containing (a) 0.05% to 10% by weight of a dithiocarbamate of the formula $R_1(R_2)N—C(:S)—S—(CH_2)—S—(:S)C—N(R_2)R_1$ where n is 1–4 and $R_1$ and $R_2$ are $C_1$–$C_{20}$ alkyl and (b) an oil soluble trinuclear molybdenum compound of the formula $Mo_3S_kL_n$ where k is 4–10, n is 1–4 and L is an organic ligand having sufficient carbon atoms to render the trinuclear molybdenum compound oil soluble, the compound present in such an amount as to provide 10–1000 ppm molybdenum in the composition.

2. The composition of claim 1 wherein n is 1 and $R_1$ and $R_2$ are butyl.

3. The composition of claim 1 or 2 wherein L contains a coco alkyl group.

4. The composition of claim 1 or 2 further comprising a dispersant, an antiwear additive, an antioxidant and a viscosity modifier in such amounts as to provide their normal attendant functions.

5. The composition of claim 1 or 2 wherein there is present about 50 to 750 ppm molybdenum in the oil composition.

6. The composition of claim 1 or 2 wherein there is present 150 to 500 ppm molybdenum in the oil composition.

7. The composition of claim 1 or 2 wherein there is present 0.1 to 1.5% by weight of said dithiocarbamate.

* * * * *